US006681895B2

(12) United States Patent
Virtue

(10) Patent No.: US 6,681,895 B2
(45) Date of Patent: Jan. 27, 2004

(54) PIVOTAL LEG ASSEMBLY

(76) Inventor: Keith David Virtue, 3 Beechcroft St., Coopers Plains, Queensland (AU), 4108

( * ) Notice: Subject to any disclaimer, the term of this patent is extended or adjusted under 35 U.S.C. 154(b) by 0 days.

(21) Appl. No.: 10/182,499

(22) PCT Filed: Aug. 9, 2001

(86) PCT No.: PCT/AU01/00977

§ 371 (c)(1),
(2), (4) Date: Jul. 26, 2002

(87) PCT Pub. No.: WO02/16819

PCT Pub. Date: Feb. 28, 2002

(65) Prior Publication Data

US 2003/0000770 A1 Jan. 2, 2003

(30) Foreign Application Priority Data

Aug. 22, 2000 (AT) ..... PQ9549
Feb. 22, 2001 (AT) ..... PR3287
Mar. 2, 2001 (AT) ..... PR3441

(51) Int. Cl.[7] ..... E04G 1/00; E04G 1/34

(52) U.S. Cl. ..... 182/186.3; 182/153; 182/155; 182/225

(58) Field of Search ..... 182/186.3, 153, 182/151, 181.1, 225, 224, 182.4, 155, 186.5, 186.2, 186.1; 248/235, 239, 240, 165, 166, 434, 170, 171, 439

(56) References Cited

U.S. PATENT DOCUMENTS 1,876,787 A * 9/1932 Strand ..... 182/153
3,233,701 A * 2/1966 Hentzi et al. ..... 182/155
3,700,072 A * 10/1972 Lovett ..... 182/155
3,978,943 A * 9/1976 Greenman et al. ..... 182/155
4,152,834 A 5/1979 Stansberry
4,296,834 A 10/1981 Kroger
4,298,094 A 11/1981 Strong
4,325,463 A * 4/1982 Taylor ..... 182/155
4,771,863 A 9/1988 Stansberry
4,880,080 A 11/1989 Brockman
4,967,877 A 11/1990 Wallman et al.
5,020,634 A * 6/1991 Gunderson et al. ..... 182/182.4
5,052,517 A 10/1991 Wallman et al.
5,082,249 A 1/1992 Havlovitz
D328,355 S 7/1992 Librach
5,529,270 A 6/1996 Liu
5,779,003 A 7/1998 Carty
D406,905 S 3/1999 Librach

* cited by examiner

*Primary Examiner*—Hugh B. Thompson
(74) *Attorney, Agent, or Firm*—Cantor Colburn LLP

(57) ABSTRACT

A pivoting leg assembly (10) for a sawhorse, the leg assembly comprising: a pair of pivotally movable leg members (40), the leg members movable between a storage position and operative position; a mounting body (50) for mounting the pair of leg members, the mounting body including a bridging member (70), a first support portion (80) having two first arms (82), and a second support portion (90) having two second arms (92); the bridging member extending between the two first arms; the second arms located within the first arms to form a gap between each respective first arm and second arm; wherein each leg member is pivotally mounted to at least one of the arms and sandwiched between a respective first arm and second arm within the gap.

29 Claims, 9 Drawing Sheets

PIVOTAL LEG ASSEMBLY

This application is a continuation of International Application No. PCT/AU01/00977, filed Aug. 9, 2001.

FIELD OF THE INVENTION

THIS INVENTION relates to a pivotal leg assembly for use on a sawhorse. Accordingly, the invention will be described in this context. However, it should be appreciated that the pivotal leg assembly may be used on other articles, such as tables, chairs, benches or the like.

BACKGROUND OF THE INVENTION

Sawhorses are a common tool that is found on a building site. A standard sawhorse typically has a cross member with a pair of legs that is fixed to each end of the cross member. A brace often extends between each pair of legs to provide additional reinforcement to the legs. When a load is placed on the cross member, the brace prevents the legs splaying.

Sawhorses are usually needed to be transported to and from different building sites and taken home each night by their owner. They are normally transported using a vehicle. An inherent problem with standard sawhorses is that they take up considerable space when placed within a vehicle. Standard sawhorses cannot be efficiently stacked on top of each other to reduce space. They are not very stable when placed in a normal operating position within the vehicle, as they often fall over or out of a vehicle when the vehicle travels around a corner.

In an attempt to overcome some of the above disadvantages, collapsable sawhorses have been developed. For example, U.S. Pat. No. 4,296,834 discloses a sawhorse that has a pair of legs located at each end of a cross member. Each pair of legs is able to be pivoted toward each other so that they fold underneath the cross member. However, the legs are splayed after they are pivoted, causing the sawhorse to occupy a considerable amount of space. Further, each pair of legs has a brace that prevents sawhorses from being stacked on top of each other.

The sawhorses disclosed in U.S. Pat. Nos. 4,880,080, 4,298,904 and 4,771,863 have similar stacking problems as they all have braces. Further, the exemplified collapsible sawhorses are relatively complex to manufacture.

U.S. Pat. No. 5,052,517 discloses a cross member comprising a trapezoid core to which is attached two pair of legs. The legs are pivotal and are able to move adjacent the cross member when in a storage position. However, as the legs have no brace, then the legs may become splayed. Further, the trapezoid core prevents the sawhorse from being able to be staked.

OBJECT OF THE INVENTION

It is an object of the invention to overcome or at least alleviate one or more of the above disadvantages or provide the consumer with a useful or commercial choice.

SUMMARY OF THE INVENTION

Accordingly, in one form, though it need not be the broadest or only form, the invention resides in a pivoting leg assembly for a sawhorse, the leg assembly comprising:

a pair of pivotally movable leg members, said leg members movable between a storage position and operative position; and a mounting body for mounting said pair of leg members, said mounting body including a bridging member, a first support portion having two first arms and a second support portion having two second arms;

said bridging member extending between said two first arms;

said second arms located within said first arms to form a gap between each respective first arm and second arm;

wherein each leg member is pivotally mounted to at least one of said arms and sandwiched between a respective first arm and second arm within the gap.

The leg members may be legs. Alternately, the leg members may be connected to legs.

The bridging member, first support portion and/or second support portion may be integrally formed. Preferably, the bridging member, first support portion and second support portion are separate units.

The bridging member may be attached to the first support portion. The bridging member may comprise a bridging web having two forward extending plates. Alternately, the bridging member may comprise a bridging plate.

The first support portion may be a first support bracket. The first support bracket may include a first web having two first depending side plates. The first arms may be the first depending side plates.

The second support portion may be a second support bracket. The second support bracket may include a second web having two second depending side plates. The second arms may be the second depending side plates.

Preferably, each leg member is pivotally mounted to both of said arms.

Preferably, each leg member abuts both of said arm members.

Preferably, the width of the gap is commensurate in size with the width of the leg member.

The pivotal leg assembly may include a locking mechanism to lock the leg members in at least the operative position.

The locking mechanism may include engagement member to engage the leg. The engagement member may be a pin, tab, clasp or like member.

The locking mechanism may be attached to the bridging member.

In another form, the invention resides in a sawhorse comprising a cross member attached to the two pivotal leg assemblies described herein.

Preferably, each pair of legs are pivotally mounted to different points on respective pivotal leg assemblies.

The cross member may have a top surface with two depending side surfaces. The cross member may have at least one slot located in its top surface. The cross member may be a channel, beam or like member.

Each pivotal leg assembly may include a locking mechanism to lock the leg members in at least the operative position.

The locking mechanism may be operated from an end of the sawhorse.

In yet another form, the invention resides in a trestle comprising at least one board or plank attached to two sawhorses as described previously.

Preferably, each sawhorse has at least one slot located in the cross member to attach the board.

Preferably, a plug is positioned within the slot to join the board or plank to the sawhorse.

DETAILED DESCRIPTION OF THE PREFERRED EMBODIMENT

Figure 1:
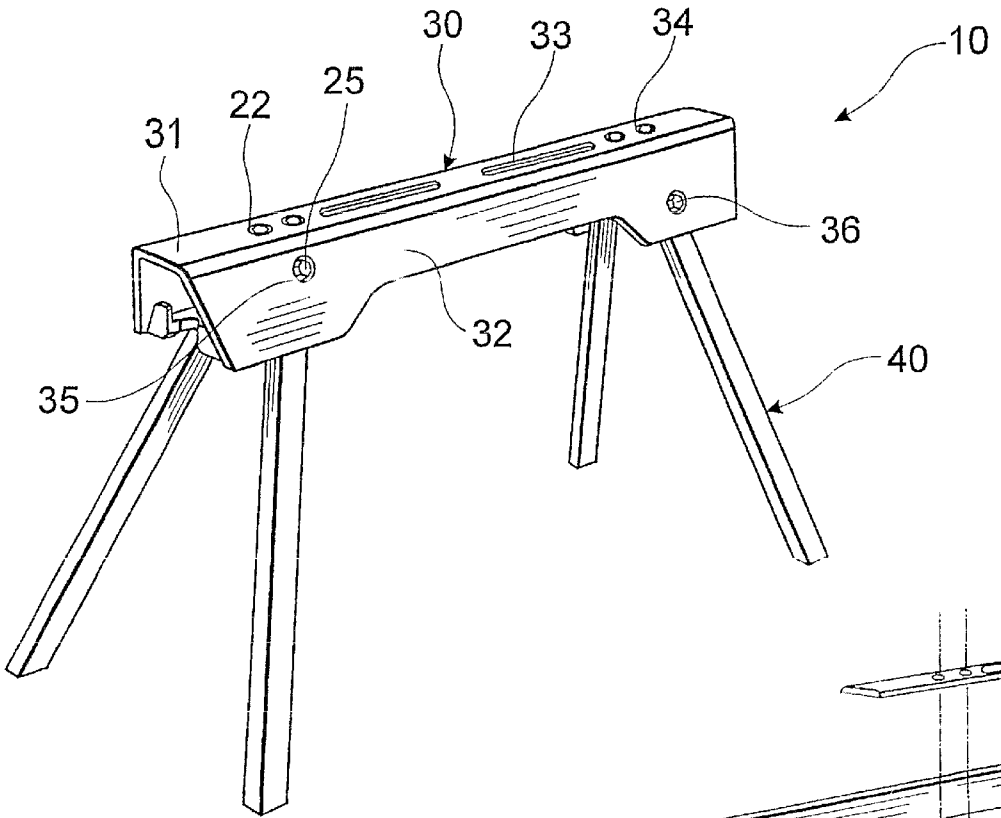
FIG. 1 is a perspective view of a sawhorse according to a first embodiment of the invention.

FIGS. 1 to 5 show a sawhorse 10 comprising two pivotal leg assemblies 20 attached to a cross member 30. The cross member 30 is a hollow channel section having a top stay 31 with two depending side stays 32. The cross member is made from laminated wood and has two slots 33 located in the top stay 31. A pair of holes 34 are located at each end of the top stay 31. On each side stay 32, there is an upper hole 35 and a lower hole 36.

Each pivotal leg assembly 20 includes a pair of legs 40, a mounting body 50 and a locking mechanism 60. The legs 40 are tubular and rectangular when view in transverse cross-section. They are made from steel or other suitable materials. A hole 41 is located through an end of the leg to pivotally mount the leg.

Figure 5:
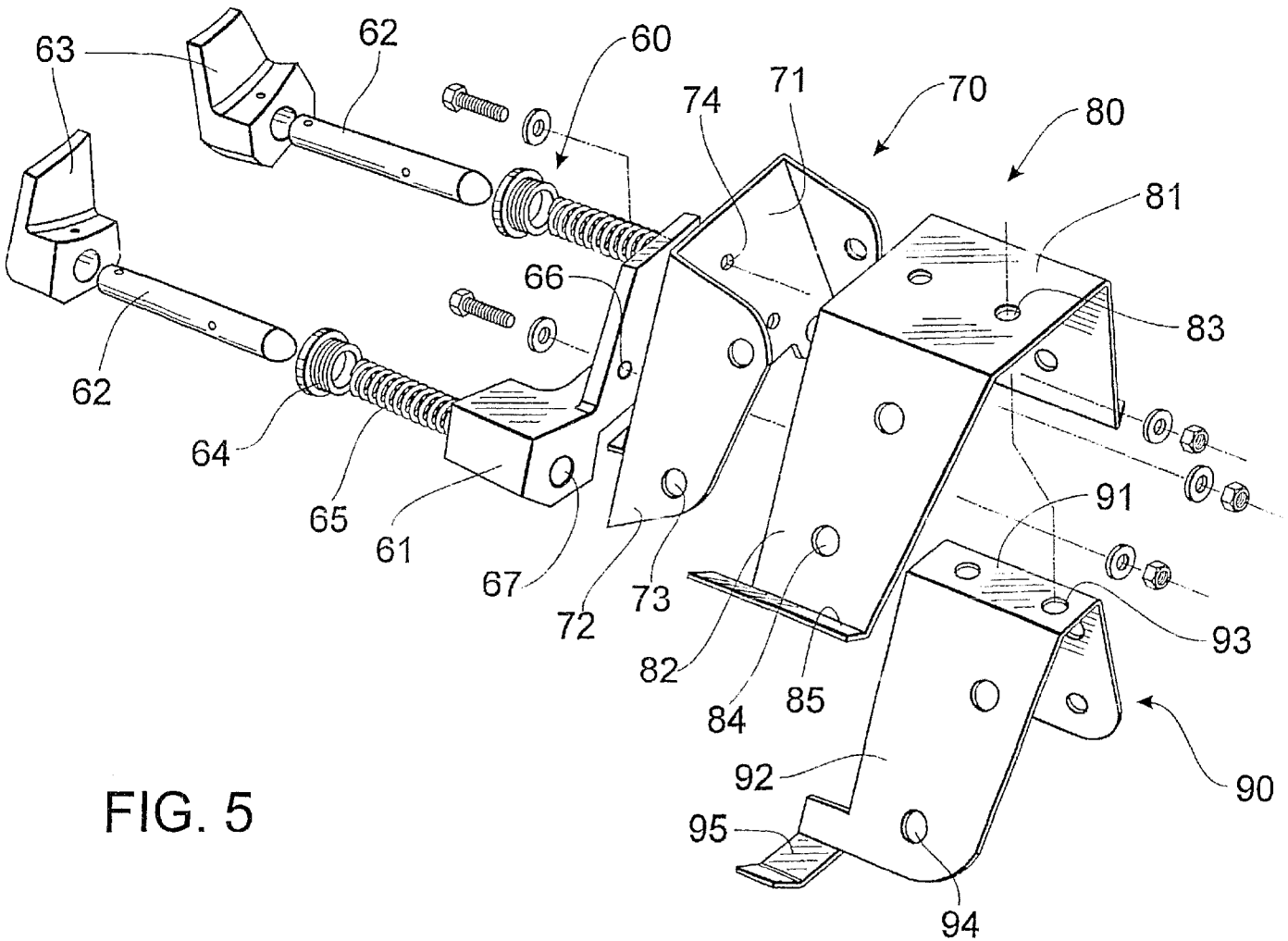
FIG. 5 is an exploded perspective view of a mounting body and locking mechanism of FIG. 1.

The mounting body 50 includes a bridging member 70, first support bracket 80 and second support bracket 90 as shown in FIG. 5. The bridging member 70, first support bracket 80 and second support bracket 90 are all constructed of high grade steel plate or other suitable high strength material.

The first support bracket 80 includes a first web 81 having two first depending side plates 82. Holes 83 and 84 are located within the first web and each first side plate. A first flange 85 extends outwardly from each first side plate.

The second bracket 90 includes a second web 91 having two depending second side plates 92. Holes are located within the second web 91 and each second side plate 92. A second flange 95 extends outwardly from each second side plate 92.

The bridging member includes a bridging web 71 having two forward extending plates 72. Holes 73 are located within the forward extending plates. Holes 74 are located within the bridge web of each forward plate 72.

The locking mechanism 60 includes lock body 61, two locking pins 62, a handle 63, two bushes 64 and two springs 65.

The sawhorse 10 is assembled by attaching the lock body 61 to the bridging web 71 by placing fasteners 21 through holes 66 and 74 located in both the lock body 61 and bridging web 71. The locking mechanism is then completed by positioning the springs 65 and bushes 64 within respective holes 67 located in the lock body 61. The handle 63 is fixed to the ends of the locking pins 62. The springs 65 are attached to respective locking pins 62 so that the locking pins 62 are able to be reciprocated within the lock body 61 and biased so that the handle 63 abuts against the lock body 61.

The mounting body 50 is formed by placing the forward plates 72 of the bridging member 70 over the first side plates 82 of the first bracket 80 so that respective holes 84 of the first side plates 82 are in alignment with respective holes 73 of the forward plates 72. The second web 91 of the second support bracket 90 is positioned against the first web 81 of the first bracket so that the holes 83 and 93 located within each web 81 and 91 are in alignment. This causes the second flange 95 to abut and support the lock body 61.

The bridging member 70, first support bracket 80 and second support bracket 90 are then placed within the cross member 30 so that the holes 83 and 93 located within respective webs 81 and 91 align within the holes 34 located within the top stay 31 of the cross member 30. The flanges 85 and 95 of the respective brackets 80 and 90 bear against the side stays 32 and 33. Bolts 22 are then passed through the holes located within the cross member, first web 81 and second web 82 and fastened with respective nuts 23.

A gap 24 is formed between each adjacent first side plate 82 and second side plate 92. The legs 40 are placed within the respective gaps 24. The respective side plates 82 and 83 are spaced such that the gaps 24 are commensurate with the width of the legs 40 so that the side plates 82 and 83 abut against the legs 40.

Bolts 25 are then placed through the side stays 32, the first side plates 82, legs 40 and the second side plate 92. Nuts 26 are then located on the bolts 25 to fasten the cross member 30, first support bracket 80, legs 40 and second support bracket 90 together.

The holes 41 in the pair of legs 40 located at one end of the sawhorse 10 is positioned higher than in the pair of legs located at the opposite end of the sawhorse. The upper holes 35 located in the side stays 32 and an upper hole 84 located in side plates 82 and 92 is utilised at one end of the cross member whilst the lower holes 36 in the side stays 32 and lower holes in the side plates 82 and 92 are utilised at the opposite end of the cross member.

Each leg 40 is movable between an operative position where the legs 40 engage a ground surface and a storage position where the legs 40 are located substantially within the cross member 30. As one pair of legs 40 is pivotally mounted at a lower position than that of the other pair of legs 40, this allows both pairs of legs 40 to be located adjacent each other when in the storage position as shown in phantom in FIG. 4.

When the pair of legs 40 are moved from the storage position to the operative position, they engage the locking pins 62. The locking pin 62 is depressed by the leg 40 until the locking pin 62 comes into alignment with a hole 42 located in a side of the leg 40. The locking pin 62 is then biased into the hole 42 to lock the leg 40 in the operative position.

When the pair of legs are to be moved from the operative position to the storage position, the handle 63 is pulled away from the lock body 61 from an end of the cross member 30 to release the locking pins 62 from the holes 42 in the legs 40. This allows the legs 40 to be rotated to the storage position. The legs maintain the storage position due to the friction force that is applied by the respective nuts 26 and bolts 25.

Figure 1A:
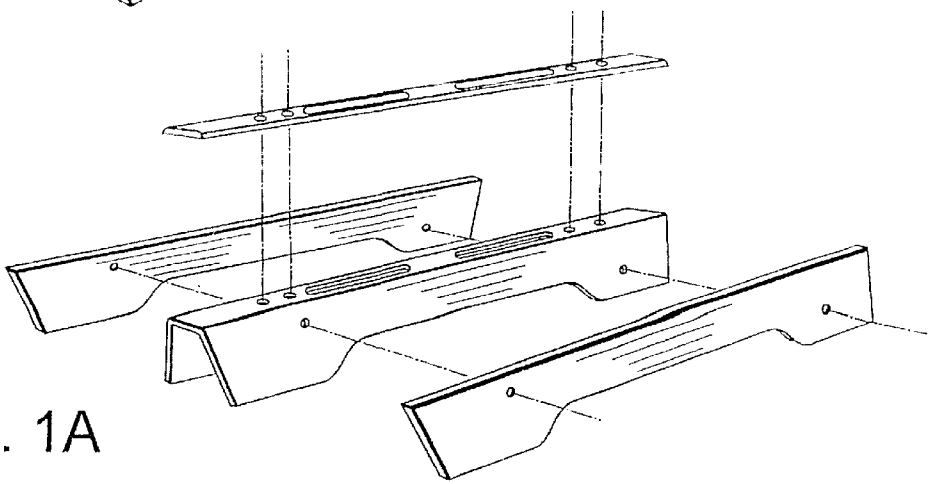
FIG. 1A is a perspective view of a cross member.
Figure 2:
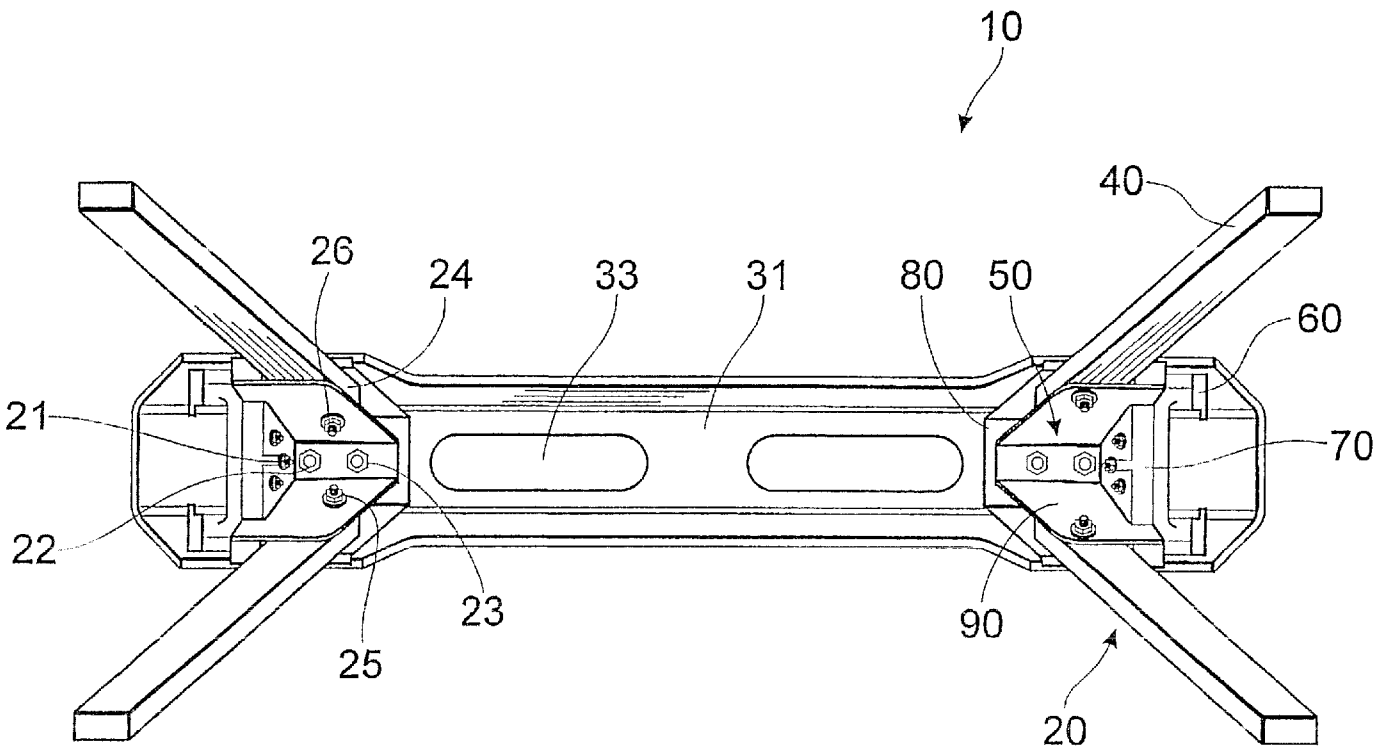
FIG. 2 is a bottom view of the sawhorse of FIG. 1.
Figure 3:
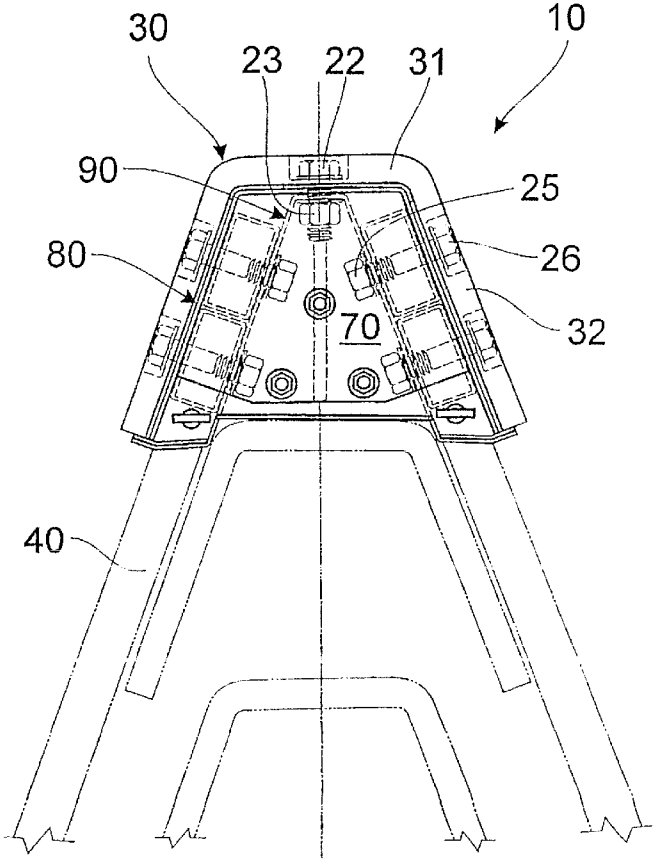
FIG. 3 is an end view of the sawhorse of FIG. 1.
Figure 4:
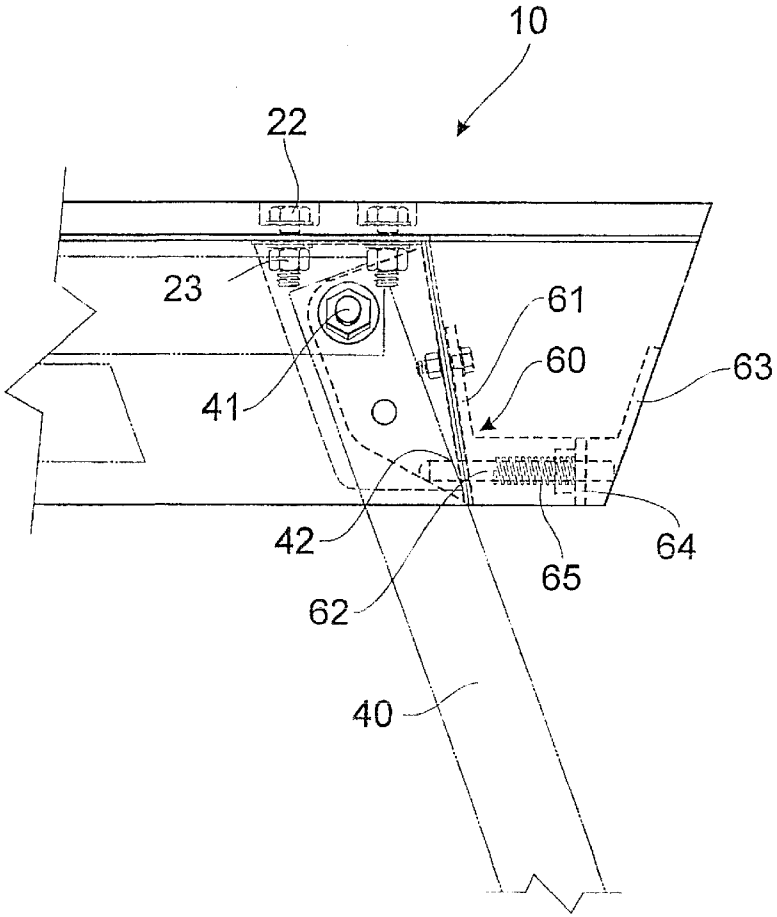
FIG. 4 is a side view of the sawhorse of FIG. 1.

It should be appreciated that in this embodiment, the first bracket 70 may not be necessary, as the channel section of the cross member enables the side stays 32 to perform the same function. The cross member is suitably composed of shaped plywood. Alternatively, the cross member may be fabricated from an engineered plastic or constructed from timber sections as illustrated in FIG. 1A.

Figure 6:
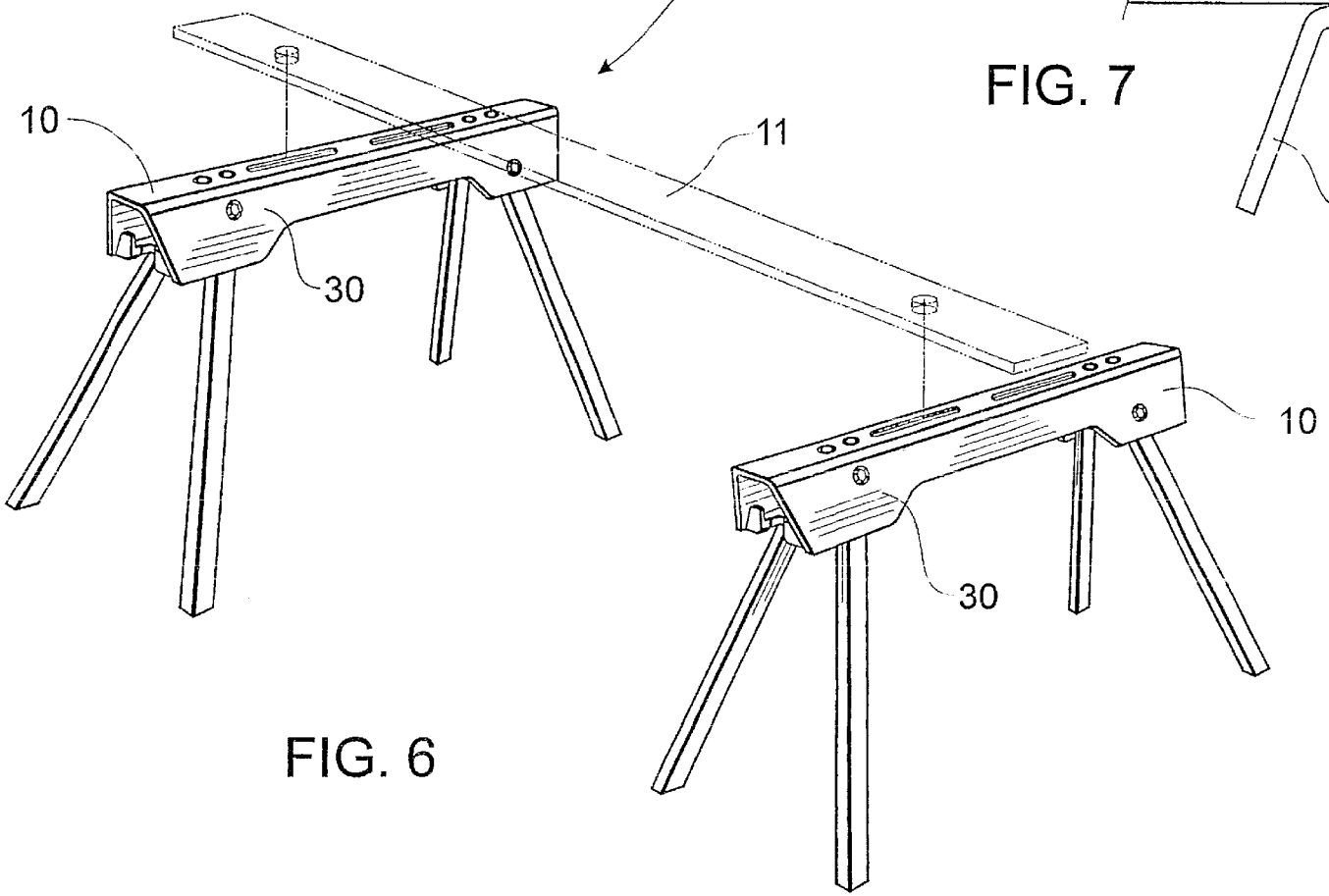
FIG. 6 is a perspective view of a board attaching two sawhorses together.
Figure 9:
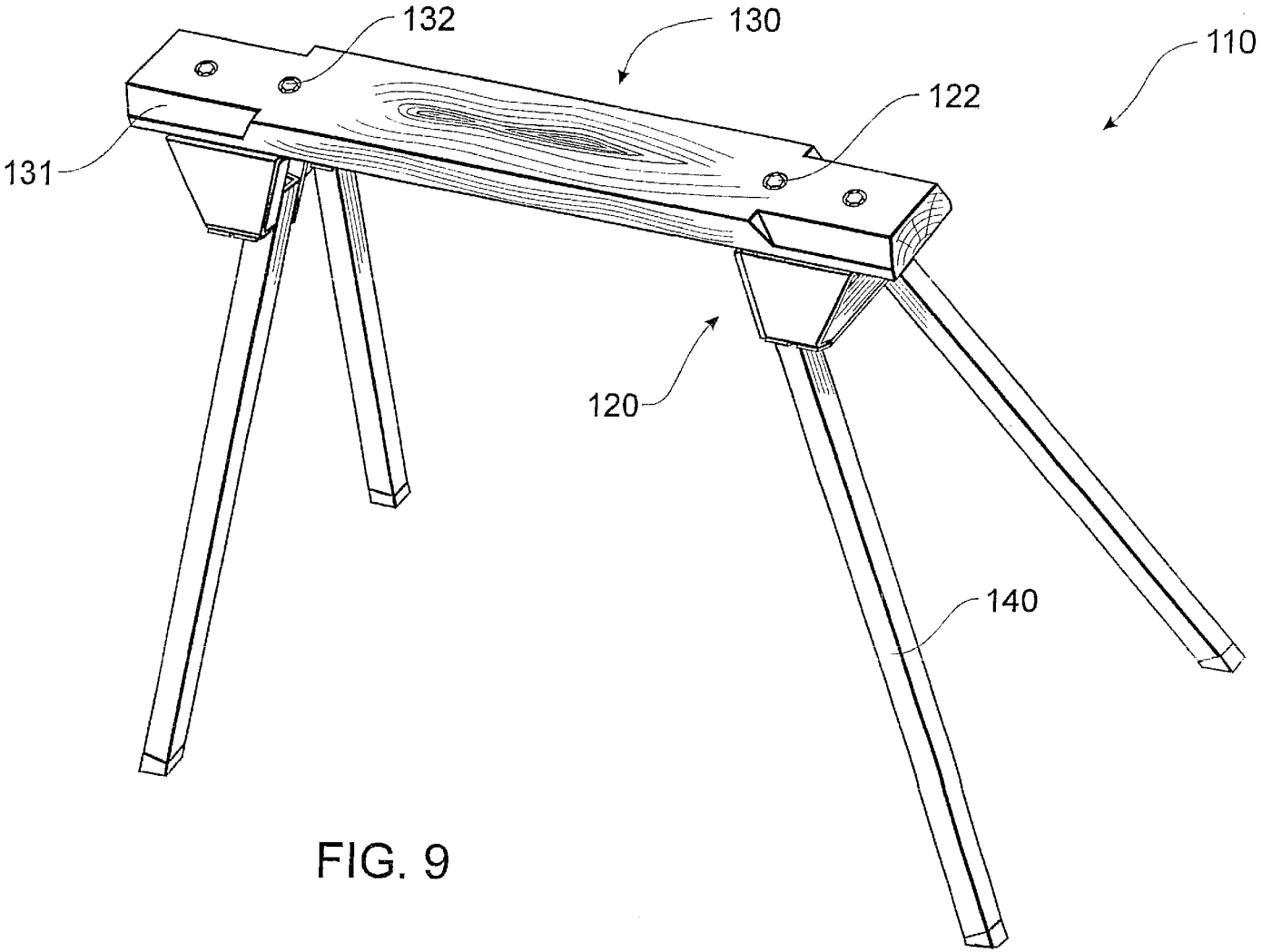
FIG. 9 is a perspective view of a sawhorse according to a second embodiment of the invention.

FIG. 6 shows two sawhorses 10 that can be secured to each other using a board or plank 11 and the slots 33 provided with the top stay of the cross member to form a trestle 12.

Figure 7:
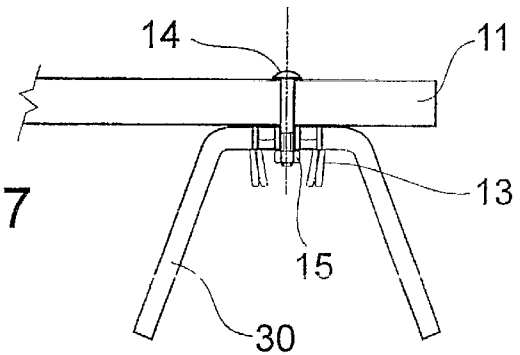
FIG. 7 is a transverse cross-section view of the board attached to a sawhorse cross member.
Figure 8:
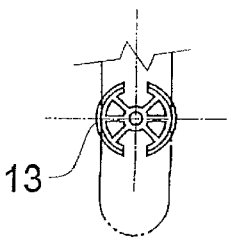
FIG. 8 is a bottom view of the board attached to the sawhorse cross member shown in FIG. 7.

A plug 13 is used to attach the board 11 to the cross member 30 as shown in FIGS. 7 and 8. The plug 13 is optionally constructed from a resilient plastics material that can be deformed to locate the plug 13 within one of the slots 33 located in the top stay 31. A bolt 14 is then passed through the board 11 and through the plug 13. A nut 15 is attached to the bolt 14 to secure the plug 13 and the board 11 together.

Sawhorses 10 can be joined together by one or more boards 11 to provide a platform for a user to access an elevated position. Alternately, boards 11 can be joined together to provide a work surface for activities, such as sawing. A workhorse may be constructed using the sawhorses 10 and boards 11 to them.

FIGS. 9 to 12 show a second embodiment of a sawhorse 110. The sawhorse 110 again comprises a two pivotal leg assemblies 120 attached to a cross member 130. The cross member in this embodiment is a solid beam having tapered edges 131 located at the sides of each end. Holes 132 are located at each end of the cross member.

Figure 11:
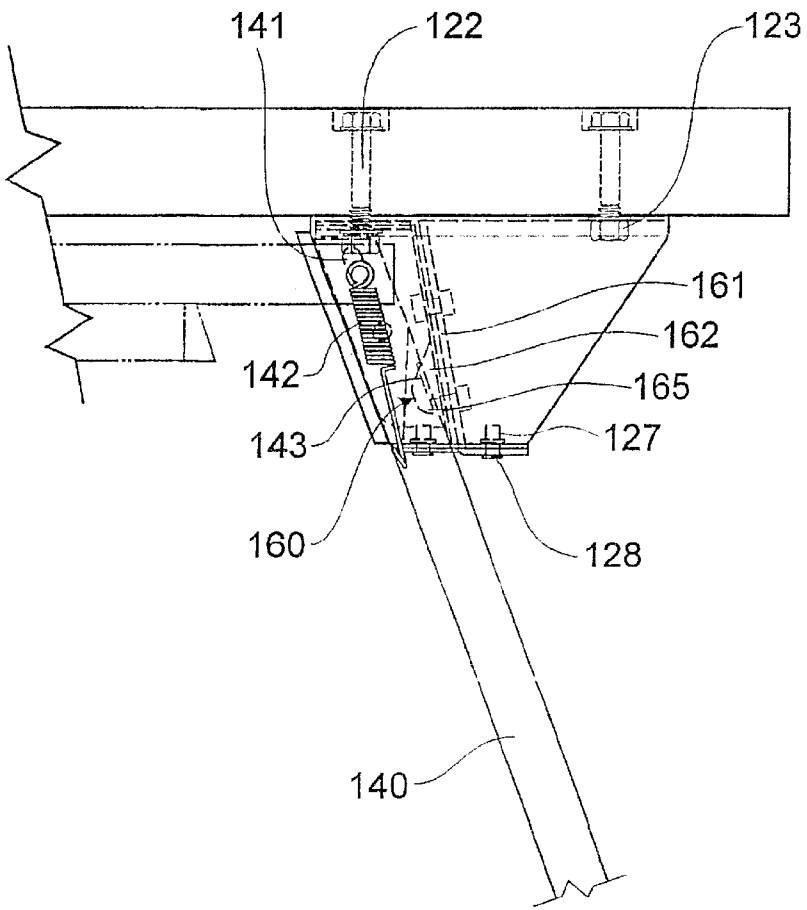
FIG. 11 is a side view of the sawhorse of FIG. 9.

Each leg assembly includes a pair of legs 140, a mounting body 150 and a locking mechanism 160. The legs are as described previously, except that the hole located within each leg in this embodiment is an elongate hole 141 as depicted in FIG. 11.

Figure 12:
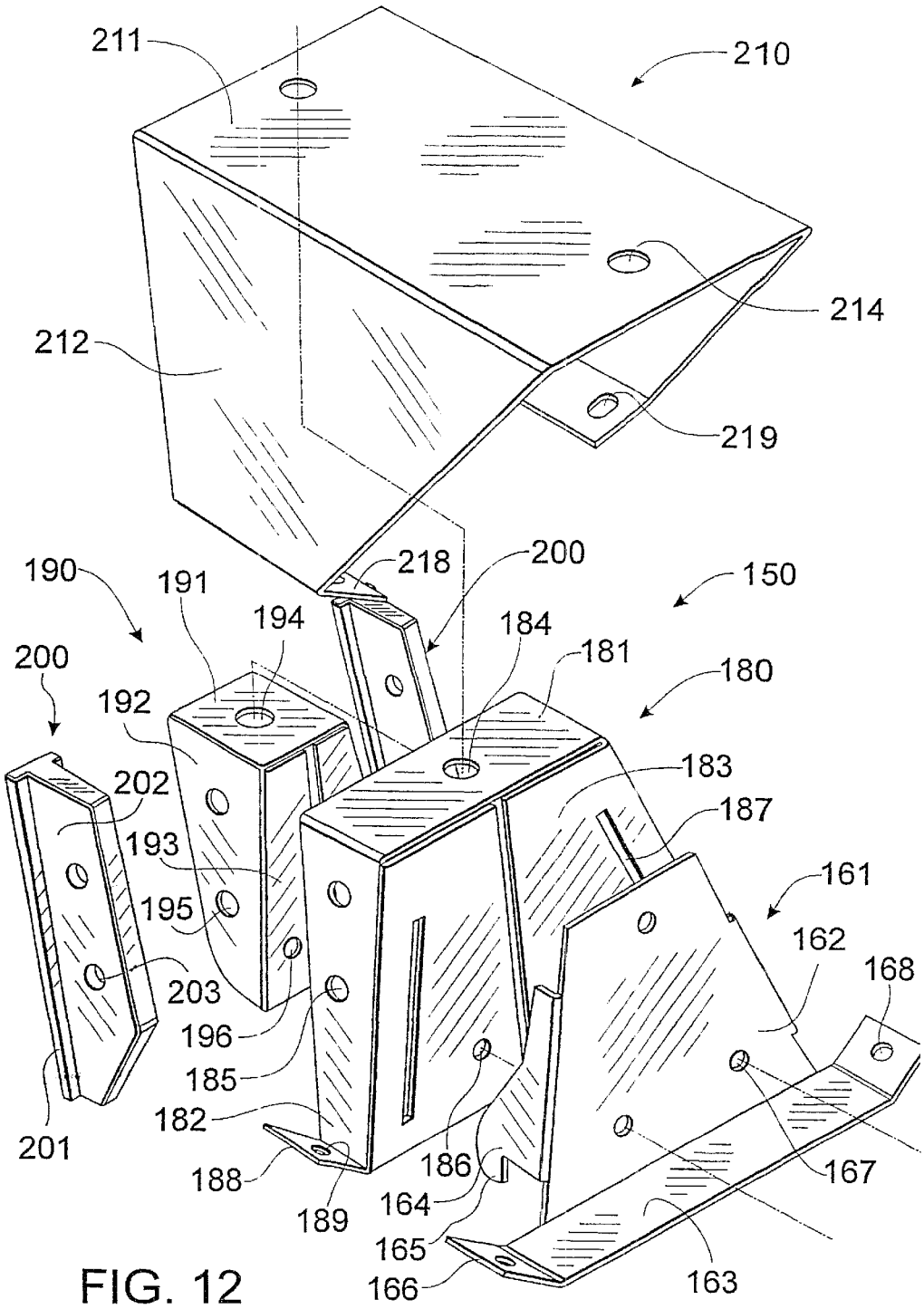
FIG. 12 is an exploded perspective view of a mounting body and locking mechanism of the sawhorse of FIG. 9.

The mounting body 150 includes a first support bracket 180, second support bracket 190, abutment members 200 and cover bracket 210, as shown in FIG. 12. The first bracket 180, second bracket 190 and cover bracket 210 are all constructed of high grade steel plate or other suitable high strength material.

The first bracket 180 includes a first web 181 having two first depending side plates 182 and a first bridging plate 183. Holes 184, 185 and 186 are located within the first web 181, each first side plate 182 and the bridging plate 183. Slots 187 are also located within the first bridging is plate 183. A first flange 188 extends outwardly from each first side plate 182 with holes 189 located therethrough.

The second bracket 190 includes a second web 191 having two second depending side plates 192 and a second bridging plate 193. Holes 194, 195 and 196 are located within the second web 191, each second side plate 192 and bridging plate 193.

Each abutment member 200 includes an abutment plate 201 and attachment plate 202. Holes 203 are located through the attachment plate. The abutment member 200 is constructed from plastic.

The cover bracket 210 has a cover web 211 with two depending side cover plates 212. Holes 214 are located in the cover web 211. A cover flange 218 is attached to the side cover plates 212. Holes 219 are located through the cover flanges 218.

The locking mechanism 160 includes a locking bracket 161 that has a face plate 162 attached to a base plate 163. Tabs 164 are located at two edges of the face plate 162. An engagement projection 165 is located on each tab 164. Locking flanges 165 are located on opposing edges of the base plate 163. Holes 167 and 168 are located in the face plate 162 and flanges 166.

The sawhorse 10 is constructed by placing the tabs 164 of the locking bracket 161 through the slots 187 in the first bridging plate 183 so that the holes 167 and 186 in the face plate 162 and first bridging plate 183 are in alignment. The second bracket 190 is placed within the first support bracket so that the holes 194 and 184, located in the second bridging plate 193 and first bridging plate 183, are in alignment. Fasteners (not shown) are then placed through the aligned holes 184 and 194. Gaps 124 are formed between the respective side plates 182 and 192.

Figure 10:
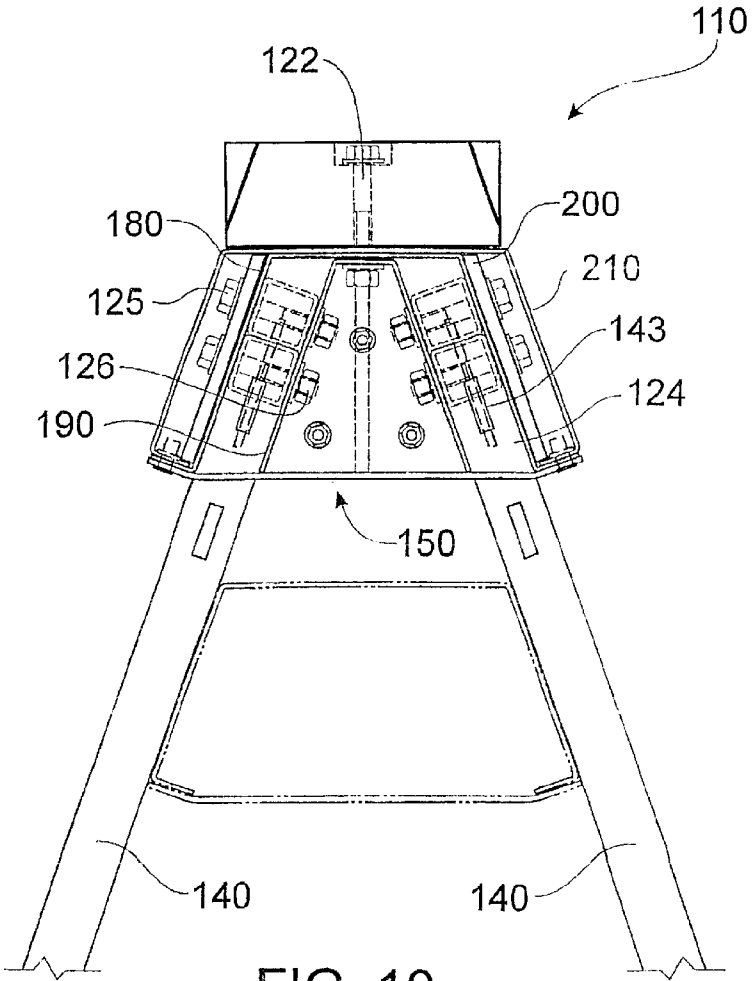
FIG. 10 is an end view of the sawhorse of FIG. 9.

The abutment members 200 are then located on respective flanges 188 of the first support bracket 180 so that the holes 203 within the attachment plate 202 are in alignment with holes 185 within the first side plates 182. Legs 140 are placed within the gaps 124 and a bolt 125 is passed through each attachment plate 201, first side plate 182, leg 140 and second side plate 192. A nut 126 is attached to the end of each bolt 125 and tightened as depicted in FIG. 10.

A spring 142 is attached inside each leg 140 and each bolt 125 as shown in FIG. 11. The cover bracket 210 is located on the first flange 188 and locking flange 218 so that holes 186, 196 and 216 located within the first web, second web and cover web are in alignment. Bolts 122 are located through the first web 181, second web 191, cover web and cross member 130. Bolts are also located through first flanges 188 and cover flanges 218, and locking flanges 165 and cover flange 218. Corresponding nuts 123 and 128 are located on the bolts.

Each pair of legs 140 is pivotally mounted to a different point on each of the pivotal leg assemblies 120. Each leg is movable between an operative position where the legs 140 engage a ground surface and a storage position where the legs are located substantially adjacent the cross member 130. As one pair of legs 140 is pivotally mounted at a lower position than that of the other pair of legs, this allows both pairs of legs to be located adjacent each other when in the storage position.

When the pair of legs 140 are moved from the storage position to the operative position, they engage the engagement projection 165. The leg is then pulled away from the cross member 130 to allow the engagement projection 165 to enter a slot 143 located within each leg 140. The leg 140 is then released so that the projection locks the leg 140 in the operative position.

When the leg 140 is to be moved to the storage position, the leg 140 is pulled away from the cross member 130 and rotated away from the engagement projection 165 to the storage position. The leg 140 fictionally engages with the abutment plate 202 to hold the leg 140 in the storage position.

Figure 13:
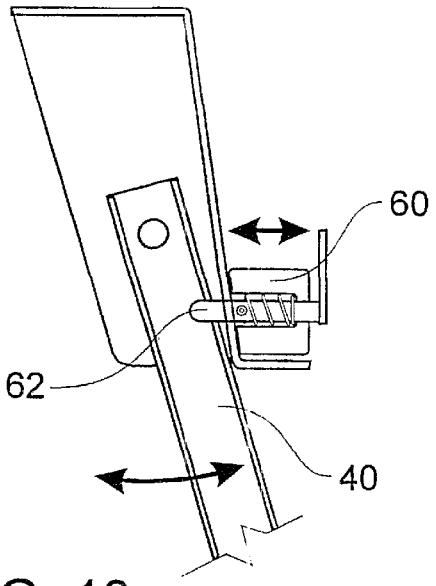
FIG. 13 is side view of the locking mechanism for the sawhorse of FIG. 1.
Figure 14:
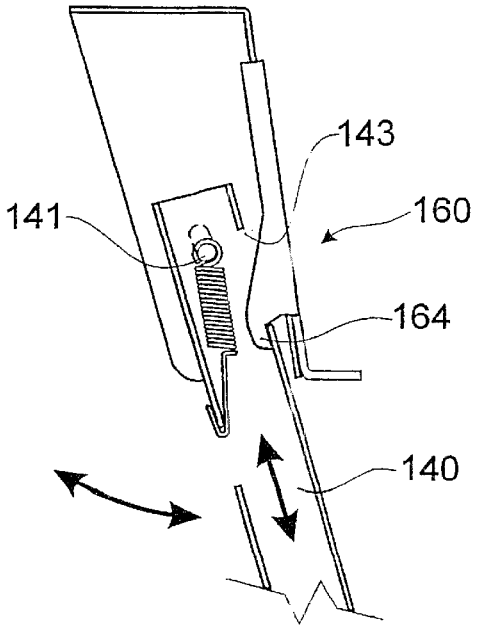
FIG. 14 is a side view of the locking mechanism for the sawhorse of FIG. 2.

FIGS. 13 and 14 show further detail of the locking mechanisms as described in first embodiment and second embodiment of the invention.

Figure 15:
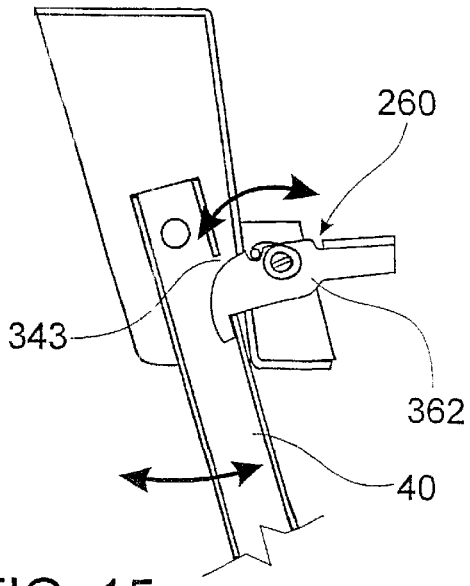
FIG. 15 is a side view of an alternate locking mechanism.

FIG. 15 shows that the locking pins 62 of FIG. 13 can be replaced with clasps 362 that engage with slot 343 of the leg to hold the leg in the operative position.

Figure 16:
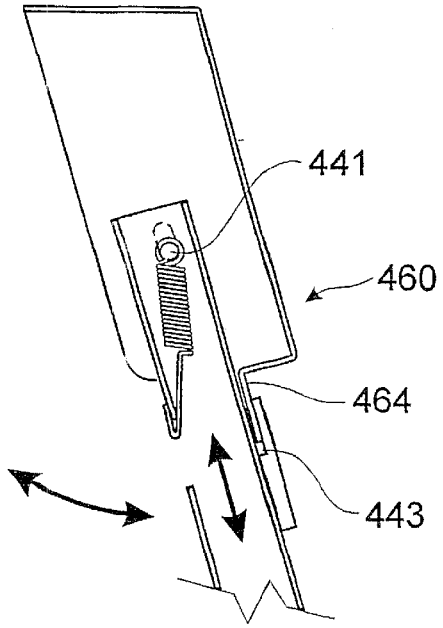
FIG. 16 is a side view of another alternate locking mechanism.

FIG. 16 shows that the tab 164 that engages with the slot 143 of FIG. 14 can be replaced by a tongue 464 that engages with a recess 343 on the leg that locks the leg in the operative position.

The sawhorse described above enables the legs to be pivoted to a storage position to allow effective stacking of the sawhorse. The pivotal leg assembly prevents the leg splaying due to its construction when the sawhorse is loaded.

It should be appreciated that various other changes and modifications may be made to the embodiments described without departing from the spirit or scope of the invention.

What is claimed is:

1. A pivotal leg assembly for a sawhorse, the leg assembly comprising:

a pair of pivotally movable leg members, said leg members movable between a storage position and operative position;

a mounting body for mounting said pair of leg members, said mounting body including a bridging member, a first support portion having two first arms, and a second support portion having two second arms;

said bridging member extending between said two first arms;

said second arms located within said first arms to form a gap between each respective first arm and second arm;

wherein each leg member is pivotally mounted to at least one of said arms and sandwiched between a respective first arm and second arm within the gap.

2. The pivotal leg assembly of claim 1, wherein the bridging member, first support portion and second support portion are integrally formed.

3. The pivotal leg assembly of claim 1, wherein the bridging member, first support portion and second support portion are separate units.

4. The pivotal leg assembly of claim 3, wherein the bridging member is attached to the first support portion.

5. The pivotal leg assembly of claim 4, wherein the bridging member comprises a bridging web having two forward extending plates.

6. The pivotal leg assembly of claim 4, wherein the bridging member comprises a bridging plate.

7. The pivotal leg assembly of claim 1, wherein the first support portion is a first support bracket.

8. The pivotal leg assembly of claim 7, wherein the first support bracket comprises a first web having two first depending side plates.

9. The pivotal leg assembly of claim 1, wherein the second support portion is a second support bracket.

10. The pivotal leg assembly of claim 9, wherein the second support bracket comprises a second web having two second depending side plates.

11. The pivotal leg assembly of claim 1, wherein each leg member is pivotally mounted to both of said arms.

12. The pivotal leg assembly of claim 1, wherein each leg member abuts both of said arm members.

13. The pivotal leg assembly of claim 1, wherein the width of the gap is commensurate in size with the width of the leg member.

14. The pivotal leg assembly of claim 1, including a locking mechanism to lock the leg members in at least the operative position.

15. The pivotal leg assembly of claim 14, wherein the locking mechanism may include an engagement member to engage the leg.

16. The pivotal leg assembly of claim 15, wherein the engagement member is a pin, tab, or clasp.

17. The pivotal leg assembly of claim 14, wherein the locking mechanism is attached to the bridging member.

18. A sawhorse comprising a cross member attached to two pivotal leg assemblies, each pivotal leg assembly comprising:

a pair of pivotally movable leg members, said leg members movable between a storage position and operative position; and a mounting body for mounting said pair of leg members, said mounting body including a bridging member; a first support portion having two first arms and a second support portion having two second arms;

said bridging member extending between said two first arms;

said second arms located within said first arms to form a gap between each respective first arm and second arm;

wherein each leg member is pivotally mounted to at least one of said arms and sandwiched between a respective first arm and second arm within the gap.

19. The sawhorse of claim 18, wherein each pair of legs are pivotally mounted to different points on each of the pivotal leg assemblies.

20. The sawhorse of claim 18, wherein the cross member has a top surface with two depending side surfaces.

21. The sawhorse of claim 18, wherein at least one slot is located within the top surface.

22. The sawhorse of claim 18, wherein the cross member is a channel.

23. The sawhorse of claim 18, wherein the cross member is a beam.

24. The sawhorse of claim 18, wherein each pivotal leg assembly includes a locking mechanism to lock the leg members in at least the operative position.

25. The sawhorse of claim 24, wherein the locking mechanism is operated from an end of the sawhorse.

26. The sawhorse of claim 18, wherein the cross member forms at least part of the first support portion.

27. A trestle comprising at least one board attached to two sawhorses, each sawhorse comprising a cross member attached to two pivotal leg assemblies, each pivotal leg assembly comprising:

a pair of pivotally movable leg members, said leg members movable between a storage position and operative position; and a mounting body for mounting said pair of leg members, said mounting body including a bridging member; a first support portion having two first arms and a second support portion having two second arms;

said bridging member extending between said two first arms;

said second arms located within said first arms to form a gap between each respective first arm and second arm;

wherein each leg member is pivotally mounted to at least one of said arms and sandwiched between a respective first arm and second arm within the gap.

28. The trestle of claim 27, wherein the sawhorse has at least one slot located in the cross member to attach the board.

29. The trestle of claim 27, wherein a plug is positioned within the slot to join the board to the sawhorse.

* * * * *